US007162184B2

(12) United States Patent
Tsusaka

(10) Patent No.: US 7,162,184 B2
(45) Date of Patent: Jan. 9, 2007

(54) IMAGE-FORMING DEVICE

(75) Inventor: Shusaku Tsusaka, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 62 days.

(21) Appl. No.: 10/858,378

(22) Filed: Jun. 2, 2004

(65) Prior Publication Data

US 2004/0265001 A1 Dec. 30, 2004

(30) Foreign Application Priority Data

Jun. 27, 2003 (JP) ..... 2003-185280

(51) Int. Cl.
*G03G 21/00* (2006.01)
*G03G 15/00* (2006.01)

(52) U.S. Cl. ..... 399/124; 399/388; 399/394

(58) Field of Classification Search ..... 399/21, 399/22, 23, 124, 125, 388, 394, 397, 401, 399/405, 407, 395
See application file for complete search history.

(56) References Cited

U.S. PATENT DOCUMENTS 5,895,036 A * 4/1999 Asao ..... 270/58.09
2002/0041775 A1* 4/2002 Ishii ..... 399/124

FOREIGN PATENT DOCUMENTS

| | | |
|---|---|---|
| JP | A 8-160833 | 6/1996 |
| JP | A 9-106125 | 4/1997 |
| JP | A 10-109773 | 4/1998 |
| JP | A 10-265083 | 10/1998 |
| JP | A 2001-282076 | 10/2001 |
| JP | A 2002-104694 | 4/2002 |
| JP | A 2002-244530 | 8/2002 |

* cited by examiner

*Primary Examiner*—Hoang Ngo
(74) *Attorney, Agent, or Firm*—Oliff & Berridge, PLC

(57) ABSTRACT

A laser printer includes a guide member for guiding a paper. The guide member includes an outer guide and an inner guide, and a top surface of the outer guide serves as a portion of a bottom surface of an accommodating space where a process cartridge is accommodated. If a paper jam occurs in a transport path defined between the outer guide and the inner guide, then a user opens a front cover and removes the process cartridge from the accommodating space. Then, the user grabs and pulls the jammed paper out of the casing. While the paper bends at an acute angle at the end of the guide member, rollers provided at the end of the guide member enable the paper to be pulled out without being torn.

20 Claims, 5 Drawing Sheets

IMAGE-FORMING DEVICE

BACKGROUND OF THE INVENTION

1. Field of the Invention

The present invention relates to an image-forming device that easily eliminates obstructions along a conveying path of a recording medium.

2. Related Art

Image-forming devices such as printers, facsimile machines, copy machines, or multifunction devices combining the functions of these machines are well known in the art. One type of image-forming device employing an electrophotographic system charges a photosensitive member and subsequently exposes the photosensitive member to light from a laser, LED, or the like to form electrostatic latent images thereon. The electrostatic latent image is developed using toner or other type of developer. The developed image is then transferred onto a recording medium and is fixed on the recording medium by heat generated in a fixing unit, thereby forming an image on the recording medium. In this type of image-forming device, a conveying path is formed from a point that a recording medium is fed into the device to a point that the recording medium is discharged from the device after passing through an image-forming unit, enabling the recording medium to be conveyed through the device without becoming jammed.

The image-forming unit is generally provided in the center of a casing or thereabout because the photosensitive member degrades in quality when exposed to light. Further, in an effort to manufacture a compact device, a cover provided on a casing to facilitate maintenance of a conveying path section from the point that a recording medium is supplied into the device to the image-forming unit also serves to cover an opening through which a developer cartridge for supplying toner or the like to the image-forming unit is inserted and removed. One example of such an image-forming device is a laser printer disclosed in Japanese unexamined patent application publication No. 2002-104694. In this laser printer, paper stacked on a paper supply tray or a multipurpose tray is fed into a conveying path by a feeding roller and conveyed toward an image-forming unit. Registration rollers register the paper and adjust the timing at which the paper is supplied to the image-forming unit. In this laser printer, a cover is provided on the front surface of a main casing near the multipurpose tray. By opening the cover, a developer cartridge accommodating toner can be inserted or removed. When paper being conveyed toward the image-forming unit becomes jammed in this laser printer, a user must open the cover on the main casing and pull the leading edge of the jammed paper in a direction that causes the paper to fold back away from the direction in which the paper was being conveyed toward the image-forming unit.

SUMMARY OF THE INVENTION

However, a problem has been associated with the type of laser printer disclosed in Japanese unexamined patent application publication No. 2002-104694. Because a jammed paper is exposed at a position upstream from the registration rollers, the user attempts to pull the jammed paper out from this exposed area, and the jammed paper comes into contact with the end portion of a guide disposed above the conveying path. Since the conveying direction of the paper and the direction in which the paper is being pulled out form an acute angle, the user must pull the paper carefully or the paper will catch on the end portion of the guide and tear.

In the view of foregoing, it is an object of the present invention to overcome the above problems, and also to provide an image-forming device that facilitates removal of jammed paper.

In order to attain the above and other objects, according to one aspect of the present invention, there is provided an image-forming device including a casing, a recording unit, a guide member, a cover, and a roller. The recoding unit forms an image on a recording medium. The guide member is disposed inside the casing and includes a first guide for guiding one surface of the recording medium and a second guide for guiding other surface of the recording medium. The recording medium is conveyed toward the recording unit in a conveying direction. The cover is provided on the casing and capable of opening and closing. The roller is provided at a downstream end of the first guide with respect to the conveying direction. The roller contacts the recording medium when the cover is open and the recording medium is pulled out of the casing from a downstream end of the guide member with respect to the conveying direction.

According to another aspect of the present invention, there is provided an image-forming device including a casing, an image forming cartridge, a guide member, and a roller. An accommodating space is formed within the casing. The image forming cartridge is detachably accommodated in the accommodating space and forms an image on a recording medium. The guide member guides the recording medium in a conveying direction toward the image forming cartridge. The guide member defines a transport path through which the recording medium is conveyed. The roller is supported at a downstream end of the guide member with respect to the conveying direction, and the roller is exposed in the accommodating space.

PREFERRED EMBODIMENT OF THE PRESENT INVENTION

A laser printer 1 according to an embodiment of the present invention will be described with reference to the accompanying drawings. First, overall structure of the laser printer 1 will be described with reference to FIGS. 1 and 2.

Figure 1:
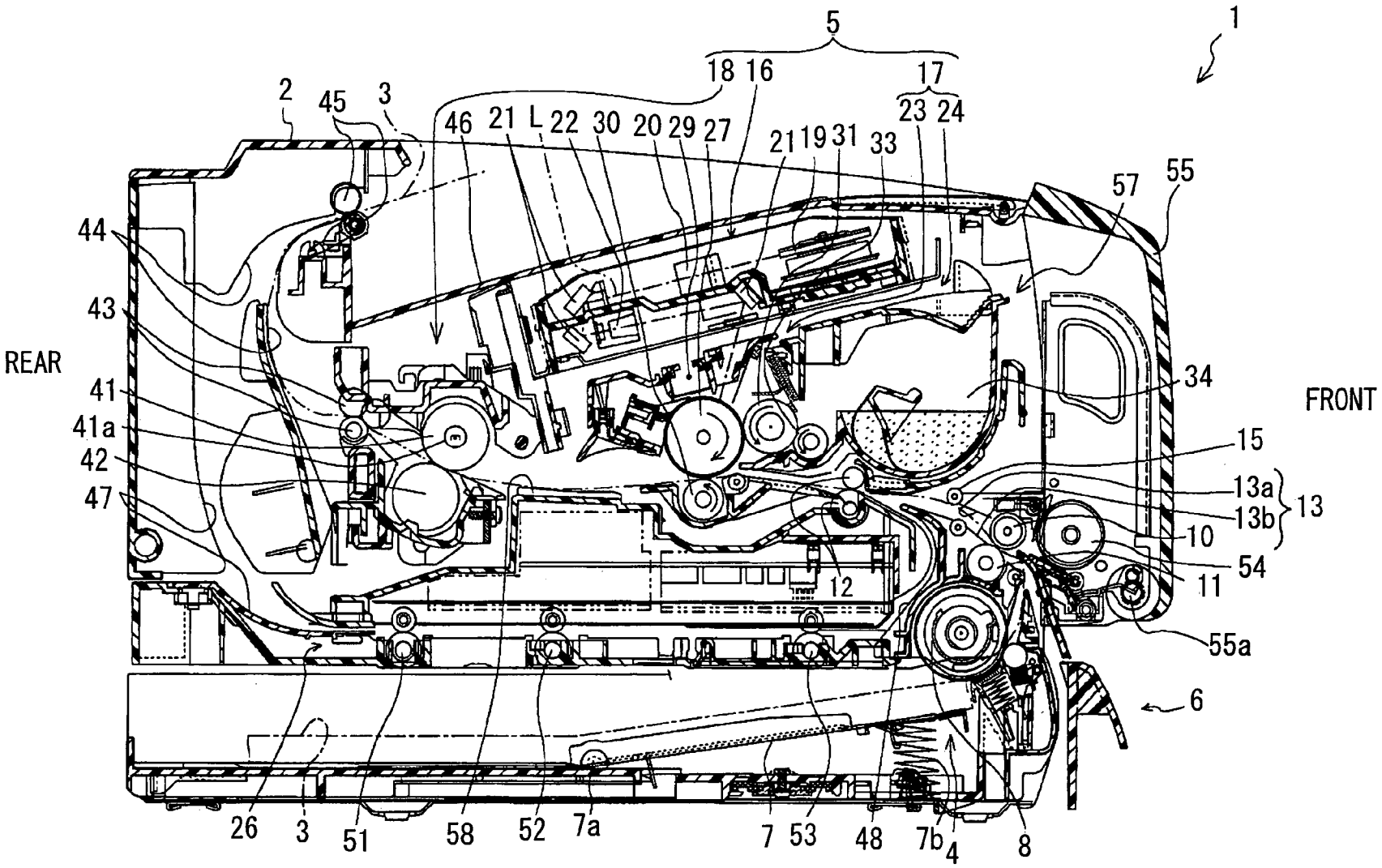
FIG. 1 is a center cross-sectional view of a laser printer according to a preferred embodiment of the present invention.

As shown in FIG. 1, the laser printer 1 includes a feeder section 4 and an image-forming unit 5, both accommodated in a casing 2. The feeder section 4 is for feeding a sheet 3.

The image-forming unit 5 is for forming images on the fed sheet 3 and includes a scanning unit 16, a process cartridge 17, and a fixing unit 18.

The feeder section 4 includes a sheet feed cassette 6, a sheet feed roller 8, a conveying roller 11, registration rollers 12, and a sheet guide member 13. The sheet feed cassette 6 is detachably mounted in the bottom section of the casing 2 and is inserted or removed from the front surface side of the laser printer 1 in the front-to-back direction. A paper pressing plate 7 is disposed in the sheet feed cassette 6 for supporting a stack of paper 3. A support shaft 7*a* is disposed on an end of the paper pressing plate 7 furthest away from the front side of the sheet feed cassette 6 for rotatably supporting the paper pressing plate 7 on the bottom surface of the sheet feed cassette 6 and enabling an opposite end of the paper pressing plate 7 near the front surface of the sheet feed cassette 6 to move vertically. A spring 7*b* is disposed beneath the free end of the paper pressing plate 7 and urges the free end upward.

Figure 2:
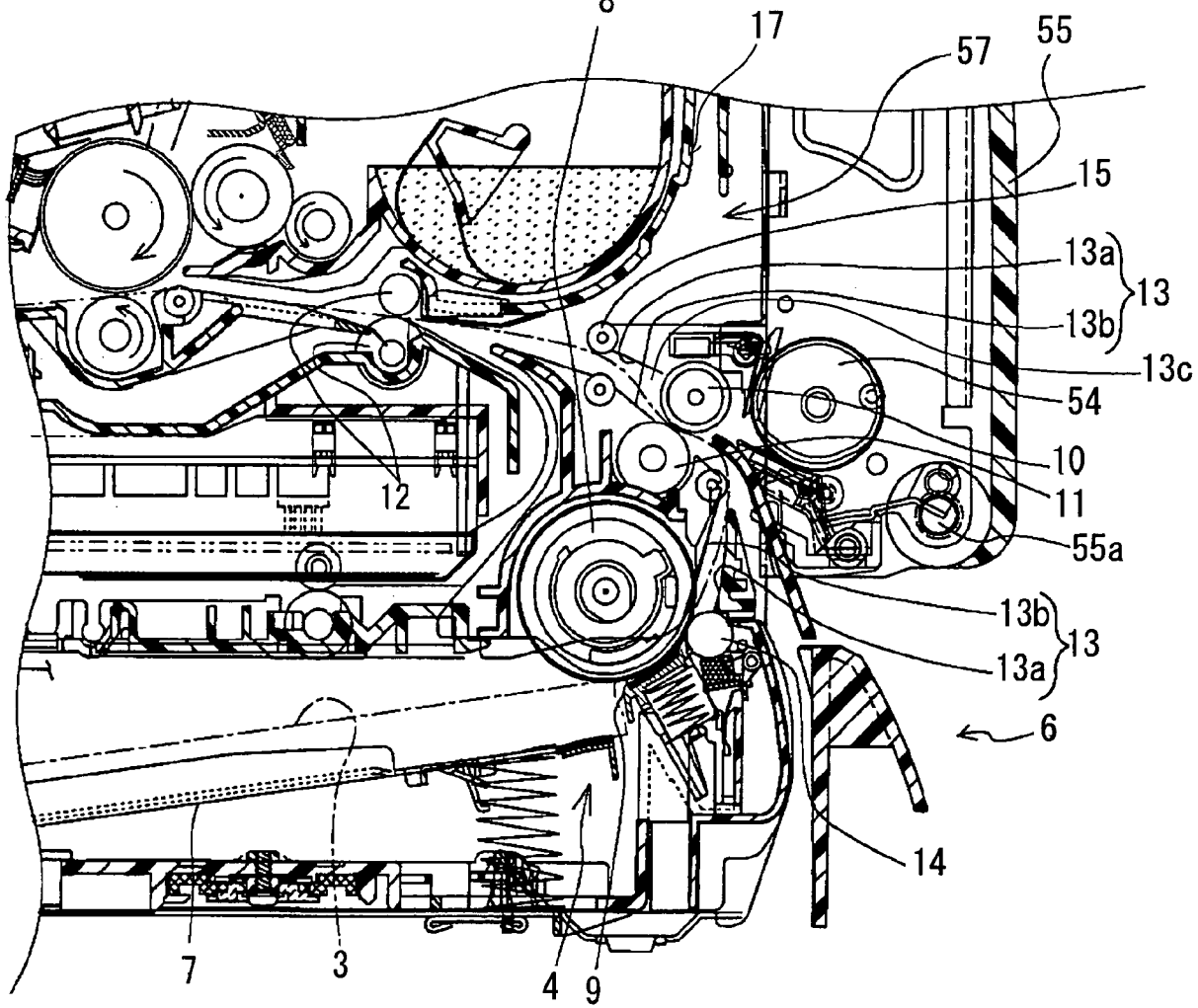
FIG. 2 is a partial expanded cross-sectional view showing the area of the laser printer near a feeding unit.

As shown in FIG. 2, the sheet feed roller 8 is positioned above the free end of the paper pressing plate 7 so that the paper 3 stacked on the paper pressing plate 7 is pressed into the sheet feed roller 8. When driven, the sheet feed roller 8 rotates in the counterclockwise direction in FIG. 2. The rotation of the sheet feed roller 8 feeds the paper 3 downstream in the rotational direction, that is, toward the front side of the laser printer 1. The paper 3 is separated and fed one sheet at a time between the sheet feed roller 8 and a separating pad 9 that presses against the sheet feed roller 8. A paper dust roller 14 is disposed downstream of the separating pad 9 in the paper conveying direction for removing paper dust generated by friction between the separating pad 9 and the paper 3.

The conveying roller 11 and a paper dust roller 10 form a pair positioned above the sheet feed roller 8. When driven by a drive motor (not shown), the conveying roller 11 conveys the paper 3, while the paper dust roller 10 contacts the outer surface and follows the movement of the conveying roller 11. The pair of registration rollers 12 is disposed behind the conveying roller 11 and the paper dust roller 10. The sheet guide member 13 is formed in a U-shape for guiding the paper 3 conveyed by the sheet feed roller 8 between the conveying roller 11 and the paper dust roller 10 to the registration rollers 12. The sheet guide member 13 includes an outer guide 13*a* and an inner guide 13*b* defining a transport path 13*c* therebetween. The outer guide 13*a* is for guiding the paper 3 on the outer side surface of the paper 3 when the paper 3 is conveyed in the curved portion of the sheet guide member 13, and the inner guide 13*b* is for guiding the paper 3 on the inner side surface of the paper 3. Both the outer guide 13*a* and the inner guide 13*b* are fixed inside the casing 2. The opposing parts (nip part) of the conveying roller 11 and the paper dust roller 10 are exposed in the transport path 13*c* of the sheet guide member 13 and serve not only to convey the paper 3, but also to remove any remaining paper dust from the surface of the paper 3 to prevent paper dust from being transported to the image-forming unit 5. Rollers 15 described later are disposed at the downstream end of the outer guide 13*a* with respect to the paper conveying direction.

As shown in FIG. 1, a partially open accommodating space 57 is formed in the casing 2 below the scanning unit 16 from the front surface to the center of the casing 2 for inserting the process cartridge 17. The side of the outer guide 13*a* opposite the side opposing the inner guide 13*b* forms a portion of the bottom surface of the accommodating space 57. The end of the transport path 13*c* of the sheet guide member 13 is exposed in the accommodating space 57 where the rollers 15 are positioned at the end of the outer guide 13*a*. When the process cartridge 17 is accommodated in the accommodating space 57, the downstream end of the transport path 13*c* with respect to the sheet conveying direction is covered by the bottom surface of the process cartridge 17.

As shown in FIG. 2, the opening of the accommodating space 57 is exposed to the outside of the casing 2 from the front side of the casing 2. A front cover 55 is provided to cover the opening of the accommodating space 57. A bottom end of the front cover 55 is supported by a support shaft 55*a* located above the sheet feed cassette 6 so that a top free end of the front cover 55 can swing open or closed about the support shaft 55*a*. The accommodating space 57 is exposed when the free end of the front cover 55 is swung downward about the support shaft 55*a*. A paper supply tray (not shown) is provided on the front cover 55 and can swing open or closed about a support shaft provided near the support shaft 55*a*. When open, paper 3 can be loaded on top of the supply tray. A feeding roller 54 protrudes from the wall of the casing 2 near the support shaft 55*a* and feeds the paper 3 loaded on the supply tray into the image-forming unit 5. Although not shown in the drawings, a slit-shaped opening is formed in the outer guide 13*a* near the paper dust roller 10 and along the axial direction of the paper dust roller 10. The paper 3 conveyed into the casing 2 by the feeding roller 54 enters the transport path 13*c* of the sheet guide member 13 through the slit-shaped opening and is conveyed toward the image-forming unit 5.

Next, the scanning unit 16 will be described in more detail. As shown in FIG. 1, the scanning unit 16 is disposed in the casing 2 directly below a discharge tray 46. The scanning unit 16 includes a laser light-emitting unit (not shown), a polygon mirror 19, an fθ lens 20, three reflecting mirrors 21, and cylinder lens 22. The laser light-emitting unit is for irradiating laser light. The polygon mirror 19 is driven to rotate in order to scan laser light emitted from the laser light-emitting unit in a main scanning direction. The fθ lens 20 is for regulating the laser light scanned by the polygon mirror 19 at a uniform scanning speed. The reflecting mirrors 21 are for modifying the optical path by reflecting the laser light in order to irradiate the scanned laser light outside the scanning unit 16. The cylinder lens 22 is for receiving incident laser light reflected by two of the reflecting mirrors 21 disposed on the upstream end of the optical path and for correcting optical face tangle error in the subscanning direction of the laser light in order to form an image on a. photosensitive drum 27 via the remaining reflecting mirror 21 disposed on the downstream end of the optical path. Hence, in the scanning unit 16, laser light emitted from the laser light-emitting unit based on print data follows a path indicated by the broken line L in FIG. 1 and is passed through or reflected off components in the order polygon mirror 19, fθ lens 20, two reflecting mirrors 21, cylinder lens 22, and one remaining reflecting mirror 21 in order to scan laser light over the surface of the photosensitive drum 27 in the process cartridge 17.

Next, the process cartridge 17 will be described. The process cartridge 17 includes a drum cartridge 23 and a developing cartridge 24 that is detachably mounted on the drum cartridge 23. The drum cartridge 23 includes the photosensitive drum 27, a charger 29, and a transfer roller 30. The developing cartridge 24 includes a developing roller 31, a supply roller 33, and a toner hopper 34.

When the process cartridge 17 including the developer cartridge 24 mounted on the drum cartridge 23 is accommodated in the accommodating space 57, the photosensitive drum 27 of the drum cartridge 23 can rotate in the direction indicated by the arrow (clockwise in FIG. 1) while in contact with the developing roller 31.

The charger 29 is disposed above the photosensitive drum 27 at a position separated from the photosensitive drum 27 by a predetermined distance. The charger 29 is a Scorotron charger that generates a corona discharge from a tungsten wire, for example, and is applied with a charging bias to charge the surface of the photosensitive drum 27 to a uniform positive charge.

The photosensitive drum 27 includes positively-charging organic photo conductor coated on a conductive base material. The positively-charging organic photo conductor is made from a charge transfer layer dispersed with a charge generation material on a charge generation layer. When the photosensitive drum 27 is exposed by a laser light, the charge generation material absorbs the light and generates a charge. The charge is transferred onto the surface of the photosensitive drum 27 and the conductive base material through the charge transfer layer and counteracts the surface potential charged by the charger 29. As a result, a potential difference is generated between regions of the photosensitive drum 27 that were exposed and regions that were not exposed by the laser light. By selectively exposing and scanning the surface of the photosensitive drum 27 with a laser beam based on print data, an electrostatic latent image is formed on the photosensitive drum 27.

The developing roller 31 is disposed further downstream than the charger 29 with respect to the rotation direction of the photosensitive drum 27. The developing roller 31 is rotatable counterclockwise as indicated by an arrow in FIG. 1. The developing roller 31 includes a roller shaft made from metal coated with a roller made from a conductive rubber material. A development bias is applied to the developing roller 31.

The supply roller 33 is rotatably disposed beside the developing roller 31 on the opposite side from the photosensitive drum 27 across the developing roller 31. The supply roller 33 is in pressed contact with the developing roller 31. The supply roller 33 is rotatable counterclockwise as indicated by an arrow in FIG. 1, which is the same rotation direction as the developing roller 31. The supply roller 33 includes a roller shaft made of metal coated with a roller made of a conductive foam material and charges toner supplied to the developing roller 31 by friction.

The toner hopper 34 is provided beside the supply roller 33 and filled with developer, which is to be supplied to the developing roller 31 by the supply roller 33. In this embodiment, non-magnetic, positive-charging, single-component toner is used as a developer. The toner is a polymeric toner obtained by copolymerizing polymeric monomers using a well-known polymerization method, such as suspending polymerization. Examples of polymeric monomers include styrene monomers and acrylic monomers. Styrene is an example of a styrene monomer. Examples of acrylic monomers include acrylic acid, alkyl (C1 to C4) acrylate, and alkyl (C1 to C4) methacrylate. A coloring agent such as carbon black, wax, and the like are mixed in the polymeric toner. An externally added agent such as silica is also added in order to improve fluidity. A particle diameter of the polymeric toner is approximately 6 μm to 10 μm.

The transfer roller 30 is disposed below the photosensitive drum 27 and downstream from the developing roller 31 with respect to the rotating direction of the photosensitive drum 27. The transfer roller 30 is rotatable counterclockwise as indicated by an arrow in FIG. 1. The transfer roller 30 includes a metal roller shaft coated with a roller made from an ion-conductive rubber material. During transfer processes, a transfer bias is applied to the transfer roller 30. The transfer-bias generates a potential difference, between the surfaces of the photosensitive drum 27 and the transfer roller 30, that electrically attracts toner that electrostatically clings to the surface of the photosensitive drum 27 to the surface of the transfer roller 30.

The fixing unit 18 is disposed to the side and downstream of the process cartridge 17. The fixing unit 18 includes a heating roller 41 and a pressing roller 42 for pressing the heating roller 41. A conveying path 58 is provided between the process cartridge 17 and the fixing unit 18 for guiding the paper 3 that has passed through the nip part of the photosensitive drum 27 and the transfer roller 30 to a nip part of the fixing roller 41 and the heating roller 42 in the fixing unit 18.

The heating roller 41 is formed by coating a hollow aluminum roller with a fluorocarbon resin and sintering the assembly. The heating roller 41 includes a metal tube and a halogen lamp 41*a* disposed inside a metal tube. The pressing roller 42 includes a base that has a low-hardness silicon rubber formed around a shaft. The base is covered by a tube formed of a fluorocarbon resin. The shaft is urged upward by a spring (not shown), pressing the pressing roller 42 against the heating roller 41. While the sheet 3 from the process cartridge 17 passes between the heating roller 41 and the pressing roller 42, the heating roller 41 pressurizes and heats toner that was transferred onto the sheet 3 in the process cartridge 17, thereby fixing the toner onto the sheet 3. Afterward, the sheet 3 is discharged from the fixing unit 18 by the conveying rollers 43 and transported along a sheet discharge path 44.

The discharge tray 46 is formed as a depression in the top of the casing 2 from the center to the front side of the casing 2, such that the slope of the discharge tray 46 grows smaller toward the front of the casing 2. The discharge tray 46 functions to hold stacked sheets of the paper 3 that have been printed. After an image has been formed on the paper 3 in the image-forming unit 5, the paper 3 is guided along the discharge path 44, which is formed in an arc, and is discharged onto the discharge tray 46 by a pair of discharge rollers 45 disposed at the end of the discharge path 44.

The laser printer 1 further includes a duplex printing unit 26, which is disposed below the image-forming unit 5 and above the paper supply cassette 6. The duplex printing unit 26 includes reverse conveying rollers 51, 52, and 53 arranged in a substantially horizontal orientation. A reverse conveying path 47 is provided on the rear side of the reverse conveying roller 51, while a reverse conveying path 48 is provided on the front side of the reverse conveying roller 53. The reverse conveying path 47 extends from the discharge roller 45 to the reverse conveying rollers 51 and branches off from the discharge path 44 near the end of the discharge path 44 in the conveying direction of the paper 3 such that a paper 3 will be guided to the duplex printing unit 26 when fed in a reverse direction. The reverse conveying path 48, on the other hand, extends from the reverse conveying roller 53 to the register rollers 12 for guiding a paper 3 to the image-forming unit 5.

Next, the sheet guide member 13 will be described in greater detail with reference to FIGS. 2–6. Here, it should be noted that, in FIGS. 2 to 6, directions −Z, +Z, −X, +X, +Y, and −Y indicate frontward, rearward, leftward, rightward, upward, and downward directions, respectively, of the laser printer 1.

As shown in FIG. 2, the top surface of the outer guide 13*a* and the end portion of the inner guide 13*b* are exposed in the accommodating space 57. The end portion of the transport path 13*c* between the end of the outer guide 13*a* and the end of the inner guide 13*b* is exposed in the accommodating space 57 and is covered by the bottom surface of the process cartridge 17. One of the registration rollers 12 is positioned deeper in the accommodating space 57 (toward the back surface of the casing 2) than the inner guide 13*b*, while the other is disposed beneath the process cartridge 17. With this construction, the paper 3 conveyed through the sheet guide member 13 enters the accommodating space 57 from the end of the sheet guide member 13, collides with the bottom surface of the process cartridge 17, and is conveyed along this bottom surface to the nip part of the registration rollers 12.

The left and right inner walls of the accommodating space 57 are configured by left and right frames of the casing 2 (not shown), and the sheet guide member 13 is fixed such that the sheet guide member 13 spans between the left and right frames. In other words, the width of the sheet guide member 13 in the left-to-right direction (X-axis in FIG. 3) is equivalent to the distance between the left and right frames of the casing 2 and is larger than the width of the paper 3.

Figure 3:
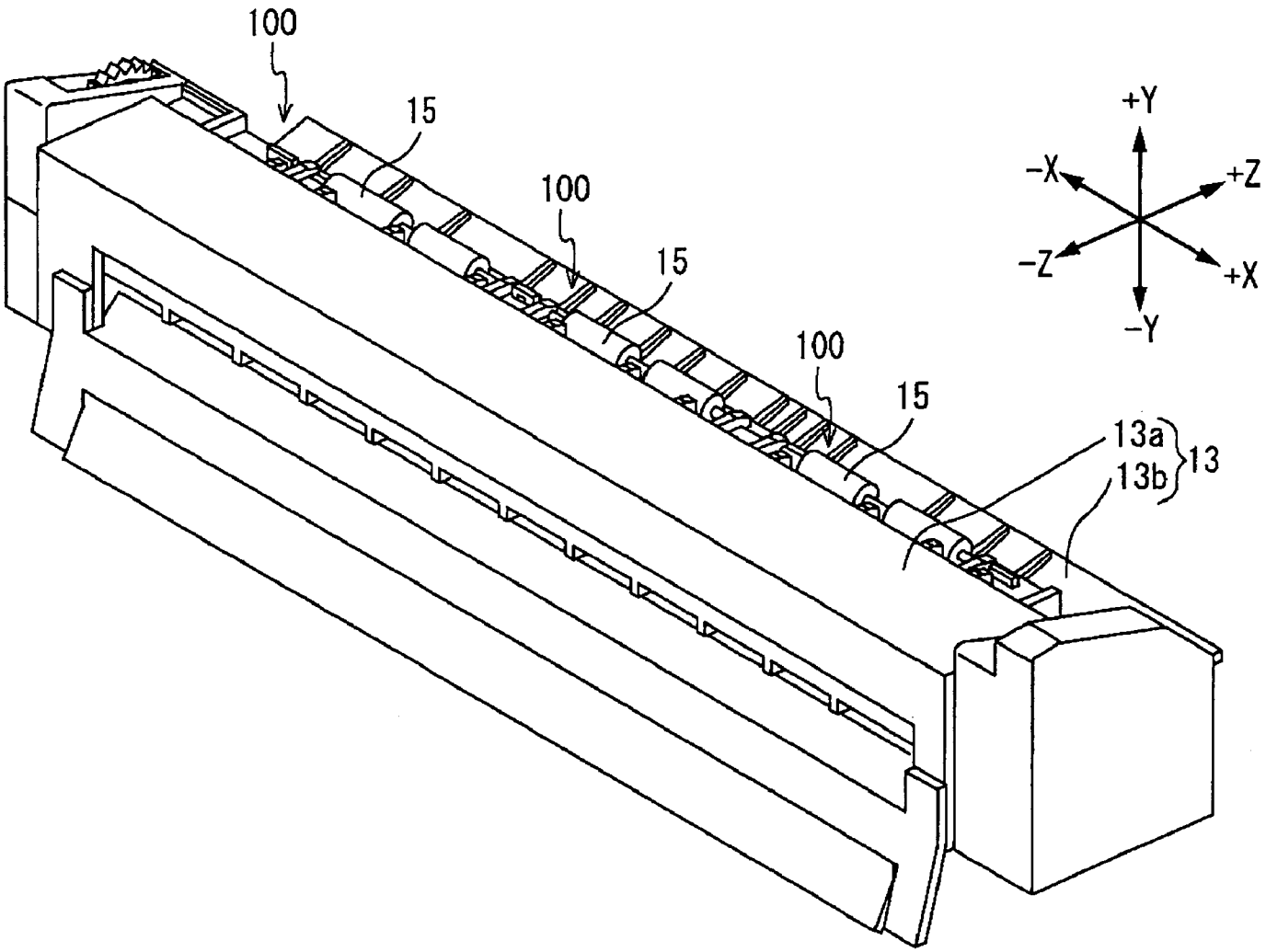
FIG. 3 is a perspective view at an angle from the front of the paper supply path near the end of an outer guide.

As shown in FIG. 3, a plurality of the roller support units 100 is provided at the end of the outer guide 13*a*. Each roller support unit 100 rotatably supports the roller 15.

Figure 4:
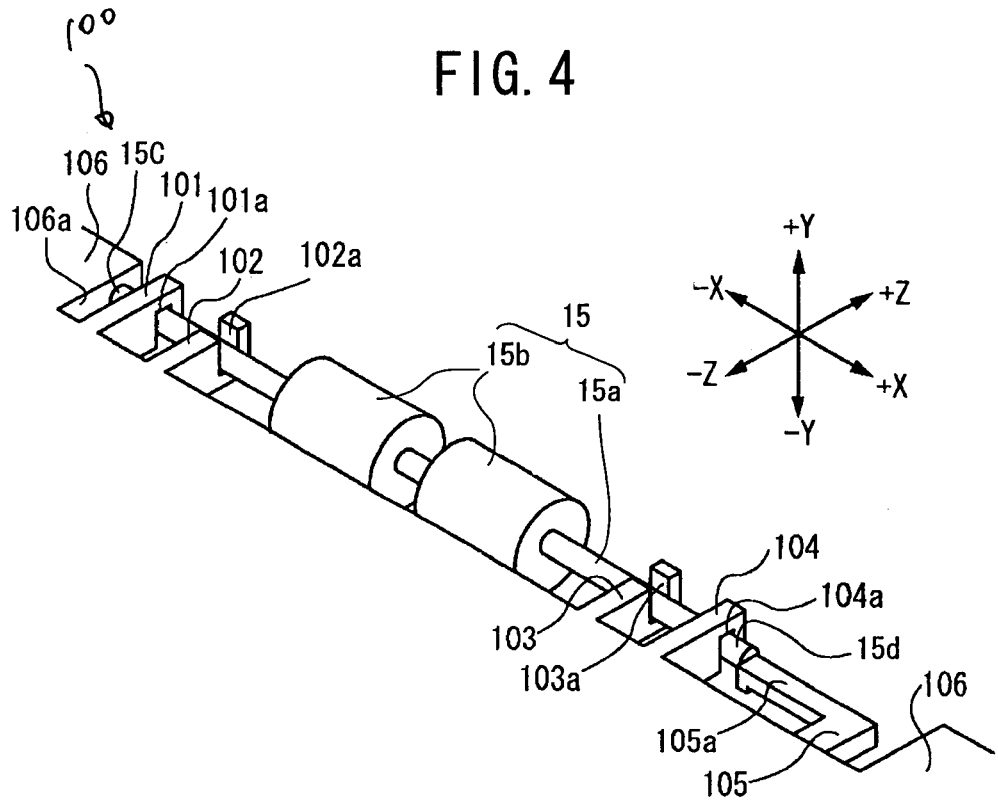
FIG. 4 is a perspective view at an angle from the front side of a roller support unit showing a roller mounted thereon.

As shown in FIG. 4, each roller support unit 100 includes shaft supporting protrusions 101, 102, 103, and 104, a stopper 105, and a shaft regulating protrusion 106. Each roller 15 includes a shaft 15*a* and roller parts 15*b*.

The shaft supporting protrusions 101, 102, 103, and 104 protrude from the end of the outer guide 13*a* toward the rear of the casing 2 (+Z direction in the drawings) to support the shaft 15*a*. Specifically, the shaft supporting protrusion 101 positioned on the left side of the roller parts 15*b* (on the −X-axis side) and the shaft supporting protrusion 104 positioned on the right side of the roller parts 15*b* (on the +X-axis side) support the shaft 15*a*, which penetrates the shaft supporting protrusions 101 and 104 in the left-to-right direction. Notched shaft support holes 101*a* and 104*a* are formed in the bottom sides of the shaft supporting protrusions 101 and 104, respectively. With this construction, the entire shaft 15*a* can be moved up and down (along the Y-axis) when mounting the roller 15 as described later. The shaft supporting protrusions 102 and 103 positioned on the left and right sides of the roller parts 15*b* support the shaft 15*a* at positions inside the shaft supporting protrusions 101 and 104. Notched shaft support holes 102*a* and 103*a* are formed in the top sides of the shaft supporting protrusions 102 and 103, respectively.

The stopper 105 protrudes from the end of the outer guide 13*a* at a position farther right from the shaft supporting protrusion 104 to prevent the roller 15 from coming out of the shaft supporting protrusions 101, 102, 103, and 104. Specifically, the stopper 105 has an end part 105*a* that contacts an end 15*d* of the shaft 15*a* on the right side, preventing the shaft 15*a* from moving along the X-axis. The end part 105*a* can move elastically up or down (along the Y-axis).

The shaft regulating protrusion 106 is positioned on the opposite side of the shaft supporting protrusions 101, 102, 103, and 104 from the stopper 105 and regulates movement of the roller 15 in the axial direction.

Figure 5:
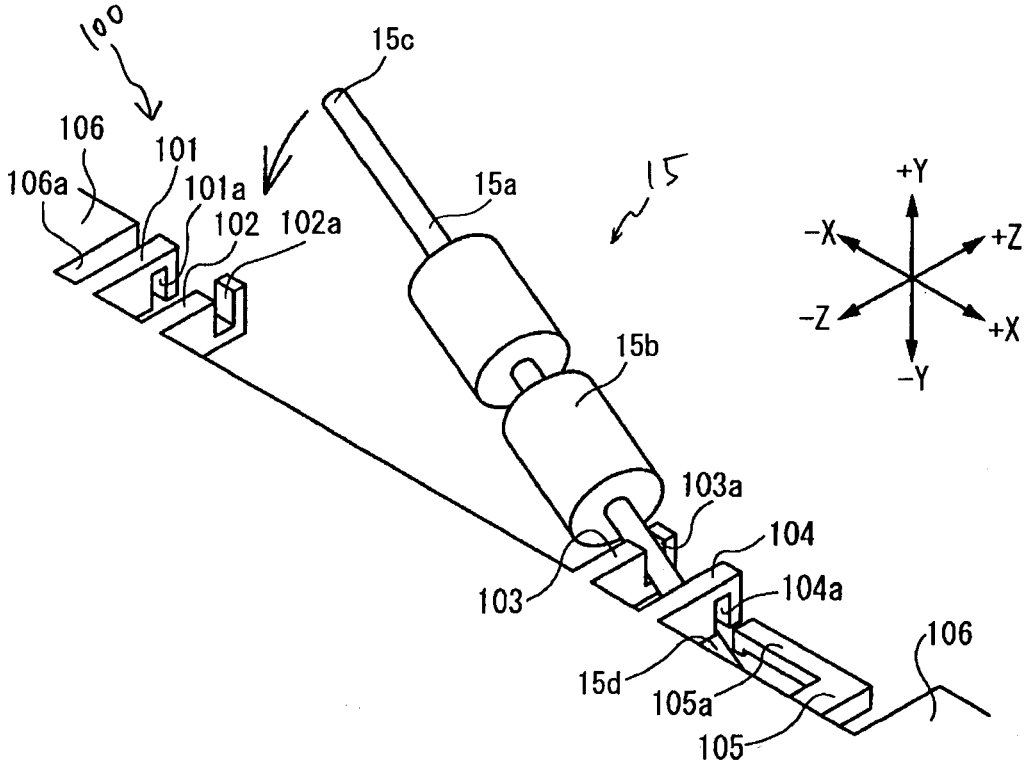
FIG. 5 is a perspective view at an angle from the front side of a roller support unit illustrating the process for mounting the roller.
Figure 6:
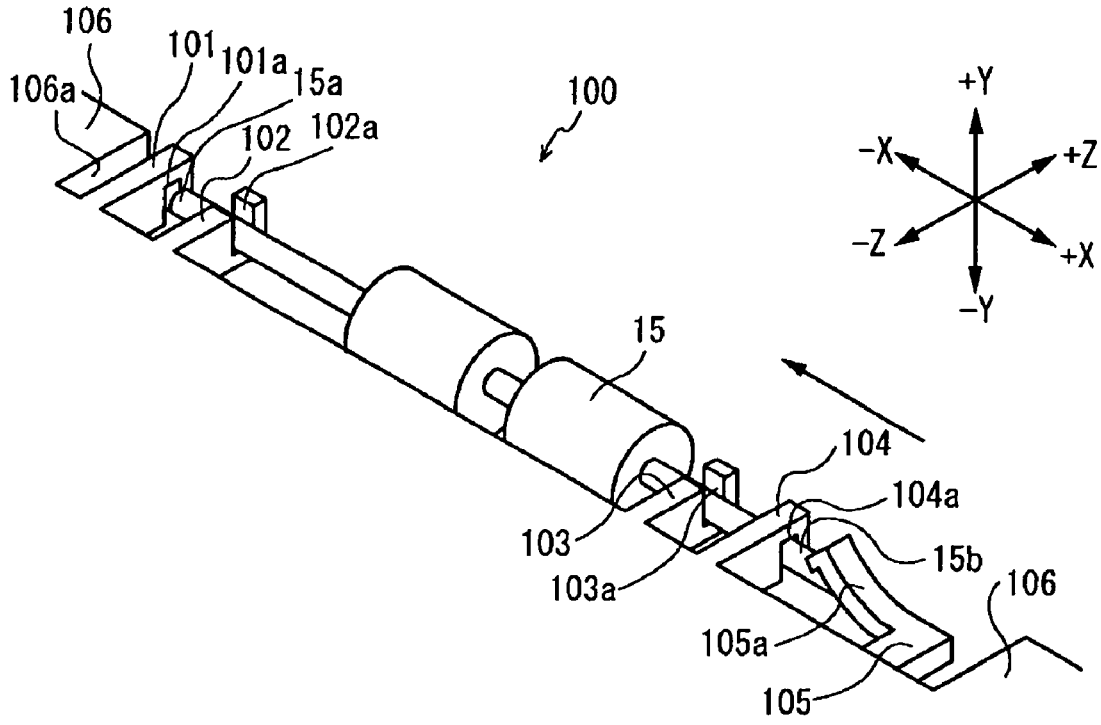
FIG. 6 is a perspective view at an angle from the front side of a roller support unit illustrating the process for mounting the roller.

The roller 15 is mounted on the roller support unit 100 in two steps. First, as shown in FIG. 5, the shaft 15*a* is attached such that the midpoint of the end 15*d* (+X-axis) is fitted into the shaft support hole 103*a* from the top (+Y-axis side) and the shaft support hole 104*a* from the bottom (−Y-axis side). The roller 15 is pivoted about the shaft support hole 103*a* so that an end 15*c* of the shaft 15*a* (−X-axis) that is opposite the end 15*d* moves downward until the shaft 15*a* fits into the shaft support hole 102*a* from the top. At this time, the end 15*d* of the shaft 15*a* contacts the end part 105*a* of the stopper 105 from the bottom, as shown in FIG. 6, pushing the end part 105*a* upward. The end part 105*a* has flexibility and, thus, bends upward.

Next, the entire roller 15 is slid to the left (toward the −X-axis) until the end 15*c* of the shaft 15*a* passes through the shaft support hole 101*a* and contacts a wall surface 106*a* on the right side of the shaft regulating protrusion 106. As a result, upward movement (+Y-axis) of the shaft 15*a* is restricted by the shaft supporting protrusions 101 and 104, while downward movement (−Y-axis) is restricted by the shaft supporting protrusions 102 and 103. The shaft supporting protrusions 101, 102, 103, and 104 also restrict movement of the shaft 15*a* in the front-to-back direction (along the Z-axis). Further, the end part 105*a* of the stopper 105, which had been pushed upward by the end 15*d*, has now been released and has returned to its original position, owing to its elastic properties. The left side surface (surface on the −X-axis side) of the end part 105*a* contacts the end 15*d* of the shaft 15*a*. Accordingly, leftward movement of the shaft 15*a* (−X-axis direction) is regulated by the shaft regulating protrusion 106, while rightward movement is regulated by the stopper 105, thereby fixing the position of the roller 15.

With this construction, the roller 15 is supported orthogonally to the conveying direction of the paper 3 (+Z-axis direction) and substantially parallel to the plane of the paper 3 (XY plane) conveyed along the transport path 13*c* between the outer guide 13*a* and the inner guide 13*b* (FIG. 2), with the entire shaft 15*a* prevented from moving in the vertical, left-to-right, and front-to-back directions.

As shown in FIGS. 2 and 3, the peripheral portion of the roller parts 15*b* protrude into the transport path 13*c* of the sheet guide member 13, preventing the surface of the paper 3 passing by the end of the sheet guide member 13 from sliding over the end of the outer guide 13*a* and, hence, protecting the end portion of the outer guide 13*a* from frictional wear caused by such sliding. Further, since a plurality of the rollers 15 are provided across the entire width of the paper 3, a gap is maintained between the end of the outer guide 13*a* and the opposing surface of the paper 3 on all widthwise areas of the paper 3, thereby reliably preventing frictional wear on the outer guide 13*a*. Further, the outer portions of the roller parts 15*b* protrude into the accommodating space 57. As will be described later, when a paper jam occurs in the transport path 13*c* of the sheet guide member 13, and a user pulls the jammed paper out of the casing 2, the roller parts 15*b* prevent the jammed paper from contacting and being torn by the corner portion of the outer guide 13*a*.

To remove the roller 15, the procedure described above is performed in reverse. Specifically, the end part 105*a* of the stopper 105 is raised and the entire roller 15 is slid to the right (+X-axis direction). This frees the end 15*c* of the shaft 15*a* from the shaft support hole 101*a*, which has been regulating upward movement of the end 15*c* (movement in the +Y-axis direction). By pivoting the shaft 15*a* about the shaft support hole 103*a* so that the end 15*c* of the shaft 15*a* (−X-axis end) moves upward, the roller 15 can be removed from the roller support unit 100.

When operating the laser printer 1, external forces in the +Z direction over the rollers 15 is incurred due to sliding force of the paper 3 being conveyed over the rollers 15. However, as described above, the paper 3 is conveyed in a direction toward the rear side of the casing 2 (+Z-axis direction) at the roller 15, while the shaft 15*a* is attached and removed in the vertical and left-to-right directions, orthogonal to the conveying direction of the paper 3 (front-to-back). That is, movement of the rollers 15 in the +Z direction is always restricted by the roller support units 100 described above. Therefore, the external forces in the +Z direction will never cause the rollers 15 to detach from the roller support units 100.

Next, printing operation of the laser printer 1 will be described. Upon receiving print data from a host computer (not shown), a drive motor (not shown) is driven, a charge bias is applied to the Scorotron charger 29, and a developing bias is applied to the developing roller 31. A transfer reverse bias is applied to the transfer roller 30 in order to clean the transfer roller 30 by transferring toner deposited on the transfer roller 30 to the photosensitive drum 27. Toner on the photosensitive drum 27 is further charged by the charger 29 and collected on the developing roller 31. Subsequently, a transfer bias is applied to the transfer roller 30.

After completing the above process, printing begins. One sheet of the paper 3 is picked up by the frictional force between the paper 3 and the rotating sheet feed roller 8 and conveyed via the conveying roller 11 to the registration rollers 12. Since the paper 3 is conveyed through the U-shaped transport path 13*c* of the sheet guide member 13, a force acts on the paper 3 to bend the paper 3 into a curve. However, the paper 3 attempts to return to its original state and, hence, the paper 3 is conveyed with its outer peripheral side sliding along the outer guide 13*a*. The rollers and the like provided along the transport path 13*c* also modify the path of the paper 3. As the paper 3 contacts the rollers 15 at the end of the sheet guide member 13, the path of the paper 3 is redirected toward the registration rollers 12.

When printing on the paper 3 loaded on the paper supply tray (not shown) equipped with an automated feeding mechanism, operations on a host computer (not shown) are performed to indicate that this supply tray is to be used. In this case, the paper 3 is picked up by the rotation of the feeding roller 54 and conveyed via the conveying roller 11 to the registration rollers 12. The registration rollers 12 register the paper 3 and convey the paper 3 at a timing designed to match the leading edge of the paper 3 with the leading edge of a visible image formed on the surface of the photosensitive drum 27.

In the scanning unit 16, laser driving signals are generated based on bitmap data created from the print data, and laser light is generated by the laser light-emitting unit and irradiated on the polygon mirror 19 based on the laser driving signals. The polygon mirror 19 moves the irradiated laser light in a main scanning direction (orthogonal to the direction for conveying the paper 3), irradiating the light on the fθ lens 20. The fθ lens 20 converts the laser light scanned by the polygon mirror 19 at a constant angular rate to a constant scanning speed. The direction of the laser light is changed by two of the reflecting mirrors 21 and directed onto the cylinder lens 22 for focusing the light beam. Subsequently, the remaining reflecting mirror 21 reflects the laser light onto the surface of the photosensitive drum 27 to form an image thereon.

The charger 29 applied with a charging bias charges the surface of the photosensitive drum 27 to a surface potential of approximately 1000V. Then, the laser beam from the scanning unit 16 scans across the surface of the photosensitive drum 27 in the main scan direction while the photosensitive drum 27 rotates in the clockwise direction. The laser beam selectively exposes and does not expose the surface of the photosensitive drum 27. That is, portions of the surface of the photosensitive drum 27 that are to be developed are exposed by the laser light and portions that are not to be developed are not exposed. The surface potential of the photosensitive drum 27 decreases to approximately 200V at exposed portions (bright parts). Because the photosensitive drum 27 rotates clockwise as indicated by an arrow in FIG. 1 at this time, the laser beam also exposes the photosensitive drum 27 in an auxiliary scanning direction, which is also the conveying direction of the sheet 3. As a result of the two scanning actions, an electrical invisible image, that is, an electrostatic latent image is formed on the surface of the photosensitive drum 27 from exposed areas and unexposed areas (dark parts).

At this time, toner supplied from the toner hopper 34 is positively tribocharged between the supply roller 33 and the developing roller 31. The toner is carried in a thin layer on the developing roller 31 after being regulated at a uniform thickness. A positive bias of approximately 400V is applied to the developing roller 31. The toner, which is borne on the developing roller 31 and charged positively, is transferred to the electrostatic latent image formed on the surface of the photosensitive drum 27 when the toner comes into contact with the photosensitive drum 27. That is, because the potential of the developing roller 31 is lower than the potential of the dark parts (+1000V) and higher than the potential of the bright parts (+200V), the positively-charged toner selectively moves to the bright parts where the potential is lower. In this way, a visible image of toner is formed on the surface of the photosensitive drum 27.

When the paper 3 passes between the photosensitive drum 27 and the transfer roller 30, a transfer forward bias is applied to the transfer roller 30. The transfer forward bias is a negative constant current at about −1000V, much lower than the potential in bright parts of the photosensitive drum 27 (+200V), causing the visible image formed on the surface of the photosensitive drum 27 to transfer onto the paper 3.

Then, the sheet 3 having the toner transferred thereon is conveyed to the fixing unit 18. The heating roller 41 of the fixing unit 18 applies heat of approximately 200 degrees, and the pressing roller 42 applies a pressure, to the sheet 3 with the toner image formed thereon so as to fix the toner image permanently on the sheet 3. Note that the heating roller 41 and the pressing roller 42 are each grounded through diodes so that the surface potential of the pressing roller 42 is lower than the surface potential of the heating roller 41. Accordingly, the positively charged toner that clings to the heating roller 41 side of the sheet 3 is electrically attracted to the lower surface potential of the pressing roller 42. Therefore, the potential problem of the toner image being distorted because the toner is attracted to the heating roller 41 at the time of fixing is prevented.

The sheet delivery roller 43 conveys the sheet 3 with the fixed toner image on the sheet delivery path 44 and delivers the sheet 3 to the sheet discharge tray 46 with a toner image side facing downward. Similarly, the sheet 3 to be printed next is stacked over the earlier delivered sheet 3 with a printed surface facing downward in the discharge tray 46. In this way, a user can obtain the sheets 3 stacked in the order of printing.

In the laser printer 1 having this construction, a paper jam can occur at any position along the conveying path from the beginning of the printing process until the paper 3 is discharged onto the discharge tray 46. If a paper jam occurs in the transport path 13*c* of the sheet guide member 13 such that a portion of the paper 3 can be seen in the accommodating space 57, a user performs a process to resolve the paper jam after first opening the front cover 55 and removing the process cartridge 17 from the accommodating space 57.

In the process to resolve the paper jam, the user grips the portion of jammed paper exposed in the accommodating space 57 and pulls the paper from the transport path 13*c*. At this time, the portion of jammed paper remaining in the transport path 13*c* is pulled from the end of the sheet guide member 13 into the accommodating space 57 and then pulled out of the casing 2 through the opening in the accommodating space 57. Since the outer guide 13*a* of the sheet guide member 13 forms part of the bottom surface of the accommodating space 57, the opening of the accommodating space 57 is positioned higher than the sheet guide member 13. Further, the end region of the sheet guide member 13 is formed to convey the paper 3 toward the rear of the casing 2, and the opening of the accommodating space 57 is positioned closer to the front side of the casing 2 than the end of the outer guide 13*a*. Accordingly, the direction in which the user pulls the exposed portion of the jammed paper out of the casing 2 forms an acute angle around the rollers 15 with the direction in which the portion of jammed paper remaining in the sheet guide member 13 is dragged toward the end of the sheet guide member 13. In other words, jammed paper in the sheet guide member 13 is pulled out over the rollers 15.

As described above, the outer portion of the rollers 15 protrude from the end of the outer guide 13*a* and contact the inside surface of the jammed paper being pulled at an acute angle through the accommodating space 57. Since the rollers 15 rotate as the jammed paper is pulled out, the frictional force applied to the inside surface of the jammed paper is reduced, enabling the paper to be removed smoothly and preventing problems, such as the paper tearing during the process to resolve the paper jam. Further, the end of the sheet guide member 13 is positioned in the accommodating space 57, and a large area can be cleared in the accommodating space 57 by removing the relatively large process cartridge 17 from the casing 2 to aid the user in resolving the paper jam.

Further, the end of the sheet guide member 13 is covered by the developer cartridge 24, which is part of the process cartridge 17. Accordingly, if it is possible to remove only the developer cartridge 24, then by removing only the developer cartridge 24 from the accommodating space 57, the end of the sheet guide member 13 can be exposed to resolve the paper jam. However, by removing the entire process cartridge 17, including the developer cartridge 24 and the drum cartridge 23, it is possible to clear up a large area in the accommodating space 57 for easily resolving the paper jam.

Because the accommodating space 57 is used both as a space for accommodating the process cartridge 17 and as a workspace for aiding the user in resolving paper jams, the laser printer 1 can be made more compact. Further, because the opening in the accommodating space 57 can be exposed for removing the process cartridge 17 by opening the front cover 55, and because the process cartridge 17 can be removed through the opening, a user can readily reach the jammed paper from the front side of the casing 2, facilitating to resolve the paper jam.

Moreover, the paper 3 is conveyed toward the rear of the casing 2 from the end of the sheet guide member 13 to the image-forming unit 5. Accordingly, if the bottom surface of the process cartridge 17 and the like slide over the portion of jammed paper exposed at the end of the sheet guide member 13 when removing the process cartridge 17, the jammed state of the paper does not worsen when the process cartridge 17 applies a force in the direction opposite the conveying direction of the paper 3. In such a case, the leading edge of the jammed paper with respect to the conveying direction can be turned back toward the front surface of the casing 2, thereby aiding the user in resolving the paper jam.

If a paper jam occurs at the beginning of the sheet guide member 13, that is, near the sheet feed roller 8, then the user can resolve the paper jam by first pulling or removing the sheet feed cassette 6 from the casing 2. As shown in FIG. 2, the beginning of the sheet guide member 13 and the feeding roller 8 are exposed in the sheet feed cassette 6. By pulling out or removing the sheet feed cassette 6 from the casing 2, the beginning of the sheet guide member 13 and the feeding roller 8 can be accessed from outside the casing 2. Particularly when the sheet feed cassette 6 is completely removed, the beginning of the sheet guide member 13 and the feeding roller 8 are exposed outside the casing 2. A paper jam may occur near the sheet feed roller 8 when the sheet feed roller 8 attempts to pick up the paper 3 from the sheet feed cassette 6 and convey the paper 3 into the sheet guide member 13. By removing or pulling out the sheet feed cassette 6, the portion of the jammed paper at the beginning of the sheet guide member 13 can be exposed outside the casing 2, enabling the user to grip and pull the jammed paper from the sheet guide member 13.

In the laser printer 1 according to the embodiment described above, the rollers 15 are provided at the end of the sheet guide member 13 for guiding the paper 3 fed from the sheet feed cassette 6 to the image-forming unit 5, and the conveying direction of the paper 3 is changed when the leading edge of the paper 3 contacts the rollers 15 exposed in the transport path 13*c* of the sheet guide member 13. Therefore, the rollers 15 can protect the end of the sheet guide member 13 from wear caused by friction from the outer surface of the paper 3 as the paper 3 is conveyed in the U-shaped curve.

The shafts of the rollers 15 are mounted onto the outer guide 13*a* in a direction orthogonal to the direction in which the paper 3 is conveyed in the sheet guide member 13 and substantially parallel to the plane of the paper 3. Accordingly, forces received from the paper 3 as the paper 3 is being conveyed or when resolving a paper jam do not cause the rollers 15 to become detached.

Unlike the conveying roller 11, the driving force from the drive motor (not shown) is not transferred to the rollers 15, and the rollers 15 can rotate freely when contacted by jammed paper being removed from the casing 2. Therefore, little force is applied to the jammed paper when being pulled from the casing 2, and the jammed paper can be removed smoothly without tearing.

Since the rollers 15 are provided across the entire width of the paper 3, jammed paper is unlikely to catch on the end of the outer guide 13*a* when resolving a paper jam.

Because the transport path 13*c* of the sheet guide member 13 is formed in a U-shape, the path for conveying the paper 3 can be constructed three-dimensionally, making it possible to construct a more compact laser printer 1.

Because the sheet guide member 13 is fixed inside of the casing 2, the construction of the laser printer 1 is simplified, since parts required to move the sheet guide member 13 are unnecessary. Although there may be concern for tearing jammed paper when pulling the jammed paper from the laser printer 1 because the fixed sheet guide member 13 does not allow the jammed paper to be pulled straight out, the rollers 13 can prevent such tearing.

While the invention has been described in detail with reference to specific embodiments thereof, it would be apparent to those skilled in the art that many modifications and variations may be made therein without departing from the spirit of the invention, the scope of which is defined by the attached claims.

For example, in the embodiment described above, a plurality of the rollers 15 is provided at the end of the sheet guide member 13. However, it is possible to provide a single roller 15 of a length spanning the entire width of the paper 3 or to provide more than the number provided in the embodiment. Further, while an acute angle is formed between the direction in which jammed paper is pulled from the sheet guide member 13 and the direction in which the portion of the jammed paper remaining in the sheet guide member 13 is dragged, any angle is possible, provided that one surface of the jammed paper contacts the rollers 15 as the paper is pulled from the casing 2 in order to prevent tearing.

Further, the method for attaching the rollers 15 to the outer guide 13*a* is not limited to that of the above-described embodiment. For example, the shaft supporting protrusions 101 and 104 and the stopper 105 may be dispensed with. In this case, with the shaft 15*a* of the roller 15 set in the same orientation as when mounted on the roller support unit 100, the shaft 15*a* can be fitted into the shaft supporting protrusions 102 and 103 from the +Y-axis toward the −Y-axis, and both ends of the shaft 15*a* may contact the left and right wall surfaces of the shaft regulating protrusions 106. With this construction, protrusions can be provided near the openings of the shaft support holes 102*a* and 103*a* in the shaft supporting protrusions 102 and 103 to prevent the shaft 15*a* from coming out of the shaft support holes 102*a* and 103*a*. Further, through-holes rather than notched shaft support holes 101*a*–104*a* may be formed in the shaft supporting protrusions 101–104, and the shaft 15*a* may be fitted into these through-holes in the X-axis direction, with the roller parts 15*b* pre-fixed in mounting positions on the roller support units 100.

Further, the rollers 15 may be configured of rollers identical to the other rollers provided along the transport path 13*c* and the discharge path 44, provided that the roller support units 100 are configured to be able to mount such rollers. This method can reduce production costs, since it is not necessary to provide new parts for the rollers 15.

While the image-forming device in the preferred embodiment described above is a laser printer, the image-forming device may be an inkjet printer, a copy machine, or another device provided with guide members that are capable of reliably conveying a recording medium toward image forming means.

What is claimed is:

1. An image-forming device comprising:

a casing;

a recording unit that forms an image on a recording medium;

a guide member, disposed inside the casing, including a first guide for guiding one surface of the recording medium and a second guide for guiding other surface of the recording medium, the recording medium being conveyed toward the recording unit in a conveying direction;

a cover provided on the casing and capable of opening and closing;

a first roller provided at a downstream end of the first guide with respect to the conveying direction;

a pair of second rollers provided in the recording unit, the pair of second rollers including an image-bearing member and a transfer roller;

a pair of third rollers provided downstream of the first roller and upstream of the pair of second rollers with respect to the conveying direction; and a pair of fourth rollers provided upstream of the first roller with respect to the conveying direction, wherein the first roller contacts the recording medium when the cover is open and the recording medium is pulled out of the casing from a downstream end of the guide member with respect to the conveying direction.

2. The image-forming device according to claim 1, wherein the cover is provided on a front side of the casing, and the guide member guides the recording medium from the front side of the casing toward a rear side of the casing.

3. The image-forming device according to claim 1, wherein when the recording medium is pulled out of the casing with the cover being open, an acute angle is formed by a portion of the recording medium located between the first guide and the second guide of the guide member as far as the first roller and a remaining portion of the recording medium extending beyond the first roller.

4. The image-forming device according to claim 1, further comprising a roller support unit disposed at the downstream end of the first guide, the roller support unit supporting the first roller, wherein:

an axial direction of the first roller mounted on the roller support unit is orthogonal to the conveying direction and parallel to the surface of the recording medium;

the first roller is mounted on the roller support unit by being slid in a first direction parallel to the axial direction of the first roller being mounted on the roller support unit toward a support position on the roller support unit; and the first roller is removed from the roller support unit by being slid in a second direction opposite to the first direction.

5. The image-forming device according to claim 1, wherein the first roller is provided across the entire width of the recording medium in a direction orthogonal to the conveying direction.

6. The image-forming device according to claim 1, further comprising a recording-medium supplying member that is disposed at an upstream end of the guide member with respect to the conveying direction and feeds the recording medium to the guide member, wherein the guide member defines a U-shaped path for changing a conveying direction of the recording medium supplied by the recording-medium supplying member from a rear side to a front side of the casing to a conveying direction from the front side to the rear side of the casing.

7. The image-forming device according to claim 6, further comprising a recording-medium supply cassette that is detachably mounted in a bottom section of the casing and accommodates a recording medium, wherein a conveying path through which a recording medium is conveyed from the recording-medium supply member to the guide member is exposed when the recording-medium supply cassette is detached from the casing.

8. The image-forming device according to claim 1, wherein the guide member defines a conveying path between the first guide and the second guide through which the recording medium is conveyed, and a part of the first roller is exposed in the conveying path, and the one surface of the recording medium contacts the first roller as the recording medium is conveyed through the conveying path.

9. The image-forming device according to claim 8, wherein the one surface of the recording medium is in constant contact with the first roller while passing the upstream end of the guide member.

10. The image-forming device according to claim 1, wherein the first guide and the second guide are fixed to the inside of the casing.

11. The image-forming device according to claim 1, further comprising a developer cartridge that is detachably mounted in the casing and accommodates developer to be supplied to the image forming unit, wherein a conveying path of the recording medium having passed the downstream end of the guide member is exposed when the cover is open and the developer cartridge is removed from the casing.

12. The image-forming device according to claim 11, wherein the image forming unit is detached together with the developer cartridge.

13. The image-forming device according to claim 1, wherein the first roller includes a plurality of roller members provided across the entire width of the recording medium with respect to a direction perpendicular to the conveying direction.

14. An image-forming device comprising:

a casing within which an accommodating space is formed;

an image forming cartridge that is detachably accommodated in the accommodating space and forms an image on a recording medium;

a guide member that guides the recording medium in a conveying direction toward the image forming cartridge, the guide member defining a transport path through which the recording medium is conveyed;

a first roller that is supported at a downstream end of the guide member with respect to the conveying direction, the first roller being exposed in the accommodating space;

a pair of second rollers including an image-bearing member provided in the image forming cartridge and a transfer roller;

a pair of third rollers provided downstream of the first roller and upstream of the pair of second rollers with respect to the conveying direction; and a pair of fourth rollers provided upstream of the first roller with respect to the conveying direction.

15. The image-forming device according to claim 14, further comprising a cover that is provided on the casing and capable of opening and closing, wherein the pair of third rollers performs registration on the recording medium, the cover is located on an opposite side of the first roller from the pair of second rollers, and the accommodating space is exposed to the outside of the casing when the cover is open.

16. The image-forming device according to claim 15, wherein the transport path defined by the guide member has a U-shape.

17. The image-forming device according to claim 15, further comprising a recording-medium supply cassette that mounts a stack of recording medium and is detachably attached to the casing, wherein an upstream end of the guide member with respect to the conveying direction is exposed to the outside of the casing when the recording-medium supply cassette is detached from the casing.

18. The image-forming device according to claim 15, wherein the first roller includes a plurality of roller members provided across the entire width of the recording medium with respect to a direction orthogonal to the conveying direction.

19. The image-forming device according to claim 15, wherein the guide member includes a first guide for guiding one surface of the recording medium and a second guide for guiding other surface of the recording medium, wherein the transport path is defined between the first guide and the second guide.

20. The image-forming device according to claim 15, wherein the first roller partially protrudes into the transport path.

* * * * *